US005489079A

United States Patent [19]

Goldber

[11] Patent Number: 5,489,079

[45] Date of Patent: Feb. 6, 1996

[54] SIDE FACING BOOK HOLDING AND PAGE TURNING DEVICE

[76] Inventor: Herbert E. Goldber, 195 Heath's Bridge Rd., Concord, Mass. 01742

[21] Appl. No.: 249,439

[22] Filed: May 27, 1994

[51] Int. Cl.[6] ..... A47B 5/04

[52] U.S. Cl. ..... 248/444.1; 248/441.1; 248/447

[58] Field of Search ..... 248/444.1, 441.1, 248/445, 447, 447.2, 451

[56] References Cited

U.S. PATENT DOCUMENTS 4,596,372 6/1986 Ford ..... 248/444.1

5,259,581 11/1993 Goldberg ..... 248/444.1

*Primary Examiner*—Leslie A. Braun

*Assistant Examiner*—Anita King

[57] ABSTRACT

A book holding structure is provided having means to allow a person lying down in a generally sideways facing posture to place a book in two positions, one for turning the pages of the book and the other for reading it.

12 Claims, 3 Drawing Sheets

SIDE FACING BOOK HOLDING AND PAGE TURNING DEVICE

SUMMARY OF THE INVENTION

This invention is directed to an improved inverted book holder, which permits a person lying in an entirely or partially sideways position to read and turn pages safely while facing in a horizontal or upward sloping direction, and does not require adjustments as the nature or size of the reading material is changed.

BACKGROUND OF THE INVENTION

This invention concerns a type of inverted book holder intended for persons who prefer or are constrained to read while lying entirely or partially on the side. It is a further development of the devices disclosed in Inventor's U.S. Pat. No. 5,259,581 and his pending patent application Ser. No. 08/147,940, which show inverted book holders designed to be used by persons in a supine or reclining posture by holding a book in two positions, one for turning the pages of the book, and the other for reading it. A pictorial disclosure of the completed invention of a side facing model was filed under the U.S. Patent Office Document Disclosure Program.

THE PRIOR ART

The idea of a side facing book holder was mentioned briefly near the end of an article on book holders on page B-1 of the Wall Street Journal of Apr. 6, 1993, and U.S. Pat. Nos. 4,896,252, 4,907,777, 5,170,983 but such book holders do not seem to be available at present.

SUMMARY OF THE INVENTION

This invention provides a book holder for use by persons who read from a sideways or a partially sideways and partially upward facing position, where a line passing through that person's eyes is not in the usual horizontal plane, but forms an angle of slant with it, which may reach 90 degrees in cases where the person lies entirely on the side without using a pillow. Pages may be turned and books of many sizes may be handled by that person without having to make mechanical adjustments or having to move about. Means are provided for storing the device in situ without loss of the page position.

THE INVENTION

In the following description as well as in the claims the term "book" or "books" will represent all reading matter, including magazines, newspapers, photographs, and any other matter being examined visually.

The invention addresses the problem of reading from a side facing position by:

(1) providing a transparent front safety surface of suitable contour, against which a book may rest for viewing with its face in a moderately forward sloping or vertical plane and with the lines of the text running in a generally downward direction. Since a transparent front surface is a concept rather than a structure and can take many forms, such as plates, grids, or frames supporting filamentary arrays, the terms "transparent plate" and "transparent member" will be used in the description below and in the claims to represent all surface structures sufficiently transparent and rigid to serve the purpose.

(2) providing a back plate to support the book in two different operating positions, the first one being generally parallel with the above mentioned transparent front plate to apply sufficient constraints to the back of the book to hold it in place, and if necessary to flatten it for viewing. The second operating position of the back plate extends in a generally horizontal or moderately sideways sloping plane, thereby opening up the book holder for loading of books and for turning of pages.

(3) providing means for moving the back plate and the book between the two operating positions described above.

(4) providing a design permitting the viewing person to make use of the foregoing provisions while lying entirely or partly on his/her right or left side with only a minor adjustment of the device.

(5) providing means to prevent injury to the user by preventing an accidental release of the book from the holder.

(6) providing a convenient and economical way of attaching the device to a bed or to a sofa, and of moving the device and the book from an operating to a storage mode by a simple rotation without losing the page position.

SPECIFICATION

DESCRIPTION OF THE INVENTION

Figure 1A:
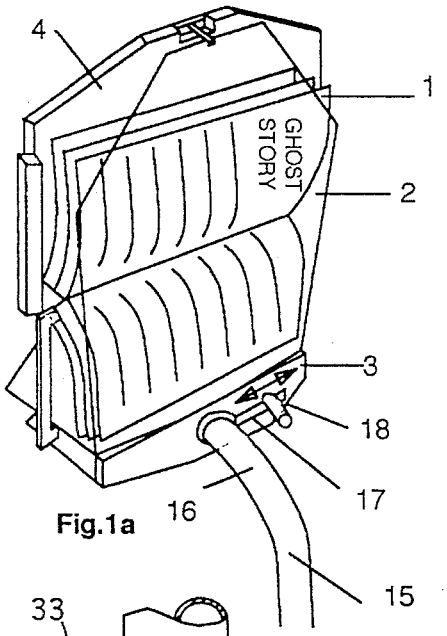
FIG. 1*a* is a perspective view of the book holder.
Figure 4:
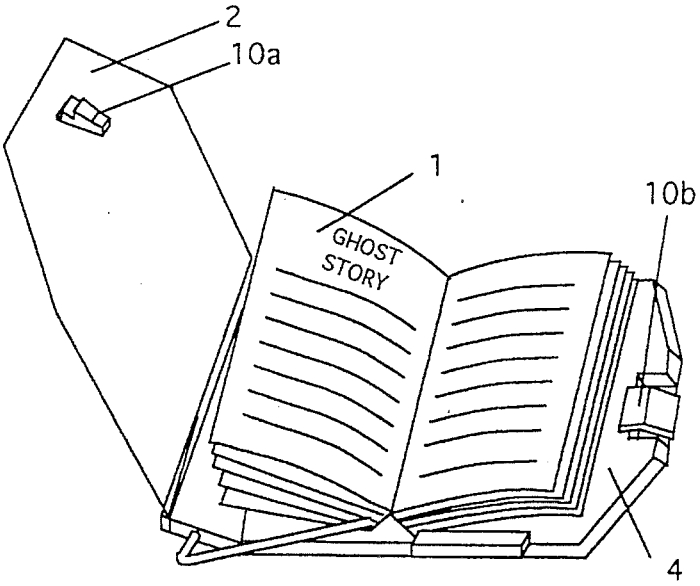
FIG. 4 is a perspective view of the book holder positioned for loading of books and/or for turning of pages.
Figure 10:
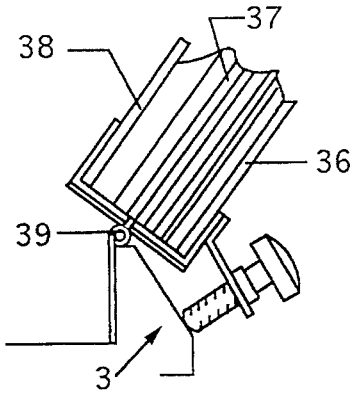
FIG. 10 is a cross-sectional view of a book holder design using an adjustable front plate.

FIG. 1*a* is a view of a Side Facing Book Holder in the page viewing position. The book 1 is held in the device with its face being supported by a transparent front member 2, in this case a flat acrylic plate. The plate 2 is attached to a base 3 in a fixed forward facing position as shown in FIG. 1*a*. An alternate hinge design allowing adjustment of the front plate angle of tilt with respect to base 3 is shown in FIG. 10 and will be described in the "Adjustments" section at the end of this specification. The back of the book is supported by a back plate 4, FIGS. 1*a* and 2, which is connected to the base 3 by a hinge 5, FIG. 2, and thus may be moved forward against the back of the book to hold it in place and flatten it as shown in FIG. 1*a*, or it may be lowered into the open position shown in FIG. 4, where the stop member 6 (shown best in FIG. 2) touches the base 3. In practice the angular spacing of plates 2 and 4 would be between 40 and 90 degrees in the open position of FIG. 4.

Figure 2:
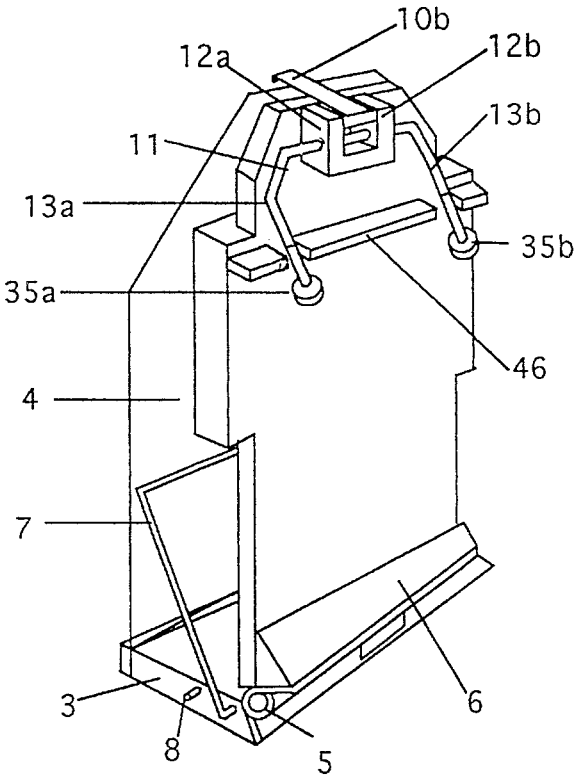
FIG. 2 is a view of the back of the book holder.
Figure 3A:
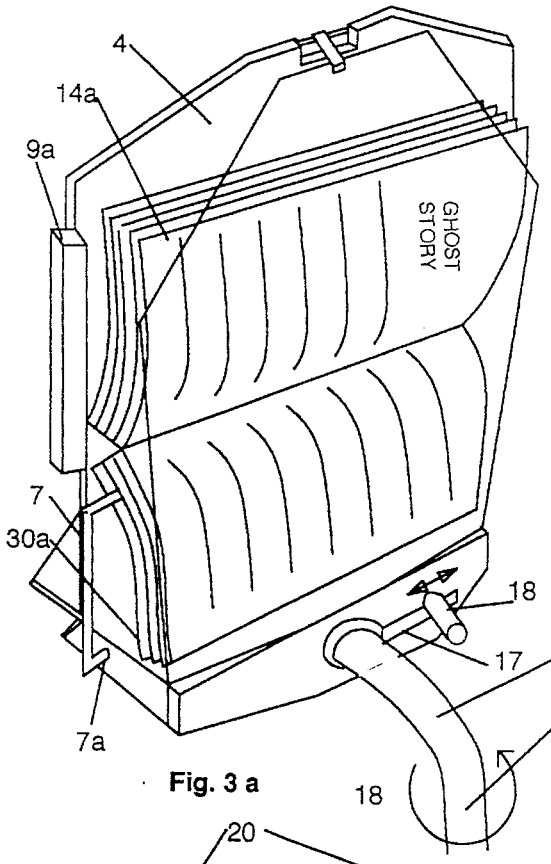
FIGS. 3*a* and 3*b* are perspective views of the book holder, carrying books as they would be viewed by a person lying entirely or partly on his/her right and left side respectively.
Figure 3B:
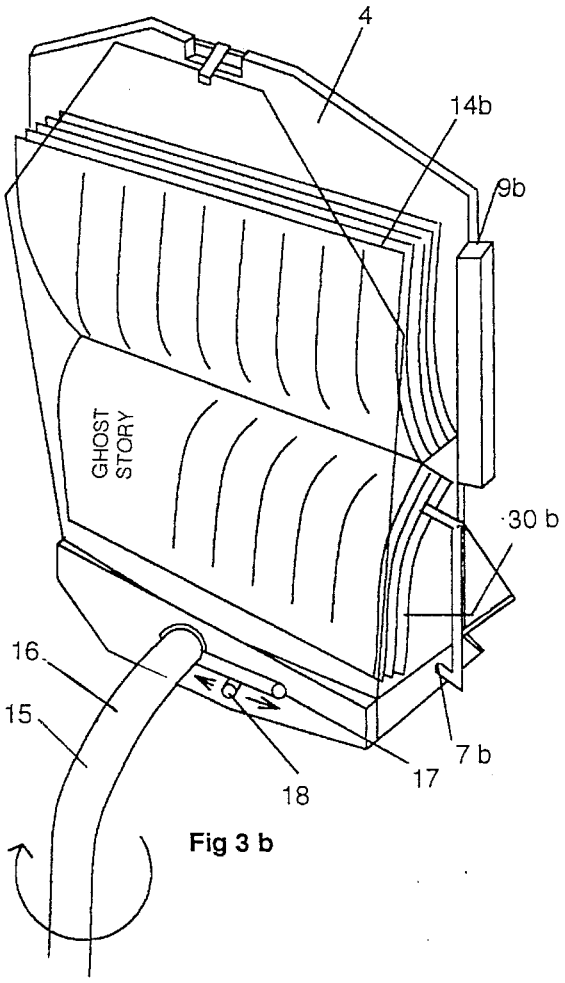

The book 1 is supported in the forward facing position by a "U" shaped wire bale 7, pivoted at ends 7*a* and 7*b* as shown in FIGS. 2, 3*a*, and 3*b*. A spring not shown in the drawing may be used to urge the bale against stop 8 (FIG. 2) to facilitate insertion of the book.

Not shown in the drawings is another form of the back plate 4, which would consist of a conventional clip board, hinged at its bottom edge to the base 3, exactly as back plate 4 is hinged shown above, but with the book cover hanging from the usual clip board clamp at the top of the clip board.

It should be noted at this point that the wire bale support or the clipboard clamp are used only to hold one of the book covers and perhaps a few adjacent pages in position as shown in FIGS. 3*a* and *b*. They do not define the place at which the book is opened for reading and are never touched unless the book is inserted, or removed from the holder.

It is also important to remember, as FIGS. 3*a* and 3*b* illustrate, that since Indo-European languages are read from left to right, successive pages start at the top of the book holder for persons lying on their right side and the wire bale must be inserted near the back cover 30*a* as shown in FIG. 3*a;* whereas for those who lie on their left side pages progress from the bottom up, so the wire bale must be inserted at or near the front cover 30*b* of the book, FIG. 3*b*.

FIGS. 3*a* and 3*b* also show two rails 9*a* and 9*b*, which run along the vertical edges of the back plate 4 to ensure the proper location of the book when it is attached to it. They are useful also to limit sideways movement of the book when the device is put into the storage mode described below.

A ratchet 10*a* (FIG. 4) is fastened to front plate 2 connecting it with a pawl 10*b* when the book holder is closed, thus stabilizing and flattening the book for viewing. The ratchet pawl is attached to an actuator 11 held in bearings 12*a* and 12*b*, and may be released by pressing one of end pieces 13*a* or 13*b* (FIG. 2). The ratchet 10*a* is also important for keeping the book in position when the book holder is moved into the storage mode described below. An interlock to ensure closure during storage is described below under the storage heading of this specification.

If the user wishes to insert or remove books or to turn pages he/she will use the left hand when lying on the right side, and the right hand when lying on the left. He/she should then apply a pinching grip to the book holder, using the thumb to press the appropriate upper page corner 14*a* or 14*b* (FIGS. 3*a* or 3*b*) against the index and/or middle finger of the same hand, placed on the relevant end piece 13*a* or 13*b* of the actuator 11 behind it (FIG. 2). The pinching grip preserves the position of the page and releases the ratchet connection between front and back plates 2 and 4, thereby allowing the user to open the book holder.

The user should then rotate the book holder about the vertical support post 15 (FIGS. 3*a* or 3*b*) by about a third turn in the directions shown by the arrows as the case may be, and at the same time open the reader by turning the back plate 4 about hinge 5 (FIG. 2). These two rotations, which can be executed simultaneously will bring the book holder into the position of FIG. 4, where it is open and conveniently aligned for generally viewing the book and for turning of pages.

After pages have been turned, the back plate 4 is raised to engage the ratchet 10*a* with pawl 10*b*, and the book holder is turned back about post 15 into the page-viewing position.

Front Plate

Figure 5A:
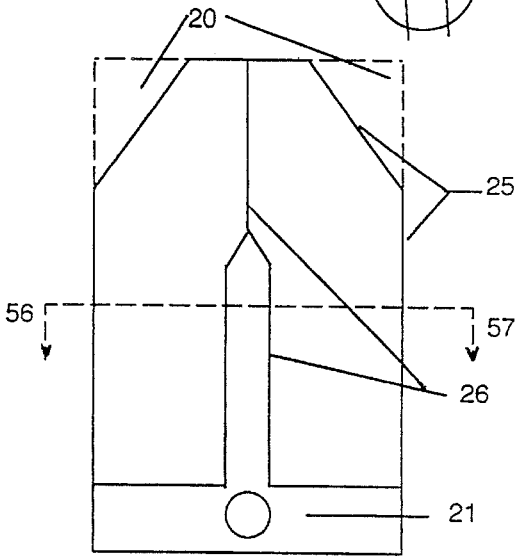
FIGS. 5*a* and 5*b* are front and cross-sectional views of a practical front plate of the book holder.
Figure 6A:
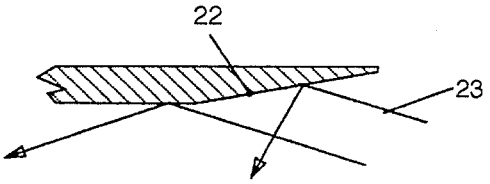
FIGS. 6*a* and 6*b* show the effects of front plate bevels on the illumination of a book holder.
Figure 5B:
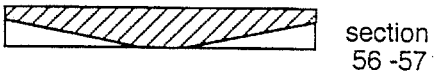
Figure 7:
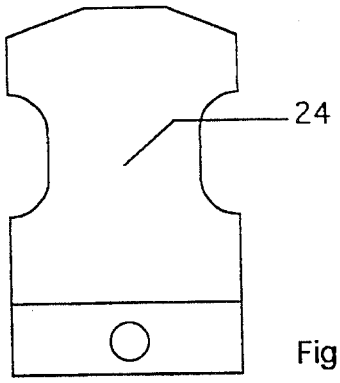
FIG. 7 is an alternate design of the front plate.

The transparent front plate can take different forms as stated above, but an acrylic plate 3/16 or ¼ inch thick is certainly a very practical structure as long as precautions are taken to eliminate or minimize the reflections of the light source into the user's eyes caused by it, and the optical discontinuities of reading across its edges. The top corners 20 (FIG. 5*a*) of front plate 21 have been cut off to expose the corners of the book to the "pinching grip" described above in connection with the page turning motion, and beveling of the edges as shown in FIGS. 5*a* and 5*b* reduces the optical discontinuities to an acceptable level. However, beveling aggravates the already existing possibility of parasitic reflections of the light source by the front plate. FIG. 6*a* shows how a bevel 22 can deflect a light ray 23 towards the user's eye. The cuts of the corners may be arranged in other ways, which may be less likely to reflect light into the field of view, for instance as shown in configuration 24 of FIG. 7. However, no matter where they are, they can cross printed matter and should be beveled. It was found that bevel angles below two or three degrees, which will move the reflected light beam by four or six degrees, can be tolerated, whereas bevel angles beyond 5° will increasingly cause disturbing reflections and should be avoided. The 2½ degree bevel of FIG. 5*a* is 3 inches wide and extending between contour lines 25 and 26. It will bring a 3/16 inch plate to an edge thickness of about 0.050 inches and represents a very reasonable solution of the edge problems.

Figure 6B:
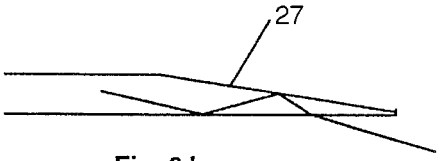

It should be noted that reflections caused by front plate bevels can be eliminated altogether if the bevel 27, FIG. 6*b*, is placed on the back side of the front plate as illustrated in the figure, where it actually directs the reflections of the light source away from the field of view, or even captures them by internal total reflection. This "back bevel" principle, while still reducing the reading discontinuities, has also been found effective also in the overhead type of book holders.

Support Stand and Storage Position

Figure 1B:
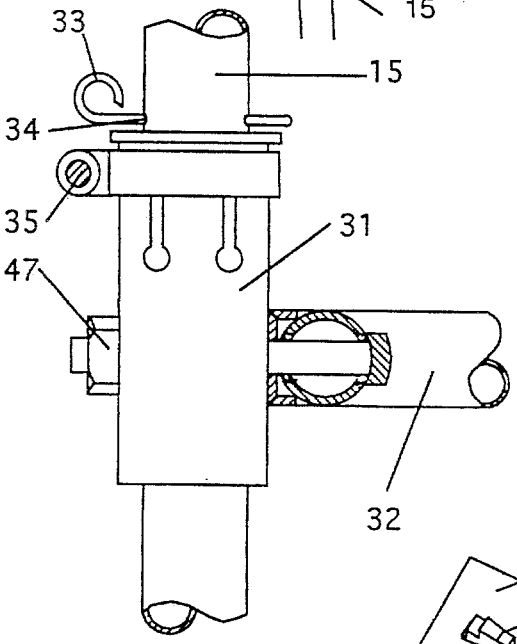
FIG. 1*b* shows an under-the-seat pillow stand as used to support the book holder on a sofa or a bed.

FIG. 1*b*, which has been drawn to a larger scale than FIG. 1*a*, shows a platform stand to be placed under a sofa seat pillow not shown in the drawing. The stand consists of a short upright tube 31 fastened to a tubular platform 32, for instance of circular or triangular perimeter. A pin 33 is inserted into one of several suitably spaced horizontal holes 34 passing through post 15 to rest on the upper end of tube 31. A friction member such as a weak clamp 35, or an O-ring or taper joint not shown in the drawings, acts between tube 31 and post 15 to prevent spontaneous rotation of the book holder. Such rotation can occur if the post 15 is not positioned sufficiently close to the vertical. The upper part 16 of the post 15 is bent over from its lower part into a backward and about 20° upward pointing direction. It carries a fixed pin 17 protruding, for instance horizontally, at a point a few inches from the end of part 16 as shown in FIGS. 3*a* and 3*b*. In the usual reading positions it bears against the stop member 18 as described below.

Figure 8A:
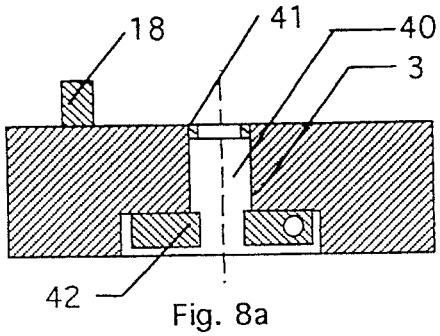
FIG. 8*a* is a cross-sectional view of the center portion of the book holder base.

The base 3 of the book holder includes a transverse hole 40 and a front bushing 41, which is dimensioned to accept the bent-over part 16 of the post 15 as shown in cross-sectional FIG. 8*a*. A stop member 18 on the front of face of the base 3 engages the upper or the lower side of the fixed pin 17 as shown respectively in FIGS. 3*a* and 3*b* to tilt the book holder approximately plus or minus 15 degrees, depending on whether the user is lying on his/her right or left side, so as to align the text of the book with the the user's plane of vision.

Figure 8B:
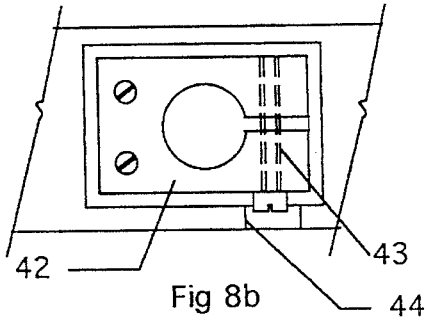
FIG. 8*b* shows the friction brake in the book holder base in elevation.
Figure 9:
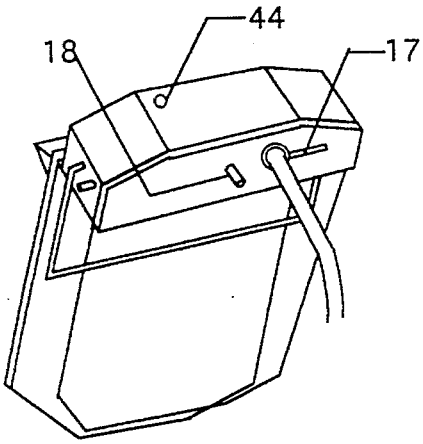
FIG. 9 is a perspective view of the book holder in its storage position.

The bushing 41, FIG. 8, is a simple sleeve, but bushing 42 is a clamping block fastened to the base 3 as shown in elevation in FIG. 8*b*. It serves as a friction brake to prevent spontaneous rotation of the loaded book holder about the upper part 16 of post 15. A control screw 43 is provided to allow the user to adjust the friction through an access hole 44, FIGS. 8*b* and 9, as needed to prevent spontaneous rotation of the book holder, while allowing a controlled rotation to convert it from right side to left side use as described above. The controlled rotation is useful also to align the text of the book with the user's plane of vision if it differs too much from 15°, depending on the number of pillows used, as well as to place the book holder into the downward pointing storage position shown in FIG. 9.

An interlock mechanism is provided to prevent the ratchet pawl 10*b* (FIG. 2) from being released by an accidental contact with the actuator 11 when the book holder is turned to the storage position. In this example it consists of sliding weights 35*a* and 35*b*, carried by the arms of actuator 11. When the book holder is in the normal operating positions these weights rest against the ends of the actuator and do not interfere with its motion. However, as the book holder is turned into the storage position, the weights slide toward the actuator bearings 12*a* and 12*b* and approach the bar 46 of back plate 4 (FIG. 2) sufficiently, but without touching it, to prevent the ratchet pawl from releasing the ratchet.

Adjustments for Unusual Requirements

Among the more important ways to adjust the book holder to meet special requirements are:

(A) For persons using several pillows or no pillows at all, the book holder orientation may be adjusted, for instances by allowing the stop member 18 (FIGS. 3*a* and 3*b*) to be movable in the direction of the arrows.

(B) For users who prefer to lie partially on their back, the 20° forward slope of the front plate may be altered for instance as shown in FIG. 10, where the front plate 36, book 37, and back plate 38 assembly is hinged to the base at hinge pin 39, allowing adjustment without interference with any of the functions described above.

(C) To permit use of the book holder on backward sloping sofa seats as well as on beds, the upright tube 31 (FIG. 1*b*) may be adjustably clamped with respect to the platform 32 through clamping nut 47. This will bring post 15 into a sufficiently vertical position to avoid the spontaneous rotation of the book holder described above.

Location of Support Post and Symmetry

The location of post 15 with respect to areas 20, FIG. 5*a*, where the book holder is held as it is moved into the page-turning position is important. If the device is symmetrical (except for pin 17 and stop 18) as shown above it may be converted easily from left side to right side use simply by moving it from storage by either clockwise or counter clockwise rotation.

Figure 11:
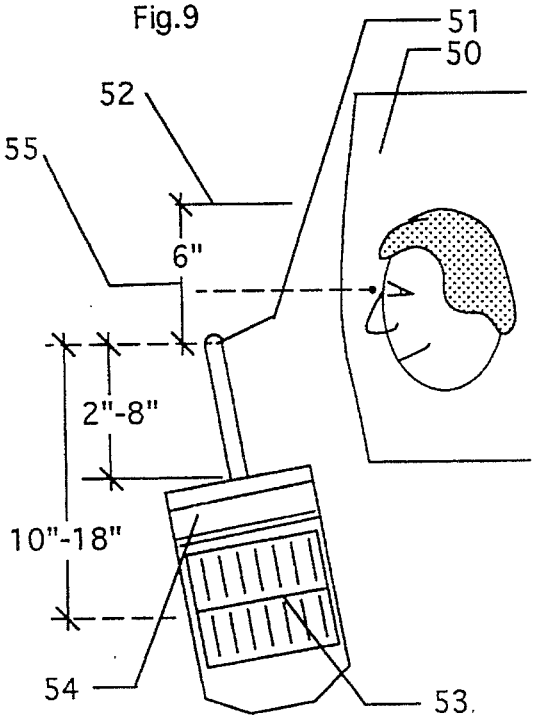
FIG. 11 is a top view of a book holder attached to a bed or sofa.

As to the location of the support post with respect to the book holder body, FIG. 11 shows schematically the relationship between the eye of the user, the page-turning positions of the center of the book, and the center of rotation of the support post. The following dimension ranges were found satisfactory, assuming a reading distance between 12 and 24 inches:

The eye level 50 of the user should extend into an area 55 between the center of rotation 51 of the support post and a point 52 about 6 inches above it.

When in the page turning position, the center 53 of the book should be about 10 to 18 inches from the center of rotation 51.

The projected distance between the base 54 of the book holder and the center of rotation 51 should be between 2 and 8 inches.

Figure 12:
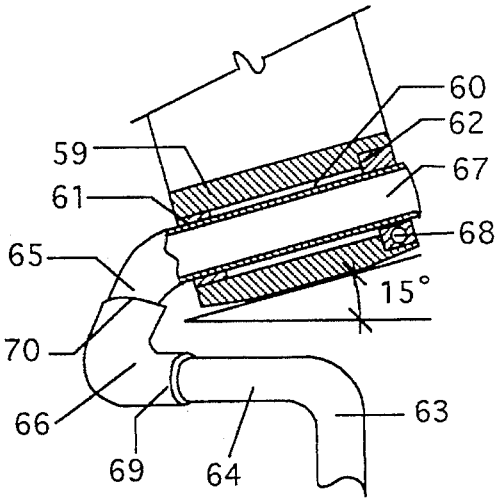
FIG. 12 is a perspective and partly cross-sectional view of an alternate stand design.

Alternatively to the support structure pictured and described above other configurations may be employed. One of them, shown in FIG. 12, provides the front plate adjustment described under (B) above inherently, that is without resorting to the more complex structure of FIG. 10.

The book holder base 59 is similar to base 3, FIG. 8*a*, except that the transverse hole 40 and the bushings 41 and 42 shown there, have been replaced by a longitudinal hole 60 and bushings 61 and 62 respectively. The modified base is being supported by a structure, which comprises a vertical post 63, which replaces post 15, FIG. 1*a*, two horizontal members 64 and 65, which are connected by a 90° elbow 66, and an arm 67, which slopes upward at 15°.

The book holder base 59 is clamped to the arm 67 by friction bushing 62, which may be adjusted by the user through an access hole 68 in the base 59. The book holder may be rotated about the arm 67 into a downward storage position, where it will hang strictly vertically, a slight advantage over the previously described design. However, in order to provide for the pillow height adjustment (A) above and for the right side to left side conversion, the elbow 66 must be designed to allow a 180° reversing motion at joint 69, as well as adjustment of the 15° angle of the sloping arm 67 by clamping means at joint 70.

Having described my invention, what I claim as new is:

1. A book holder for securing a book located thereon, wherein said book has a front cover, a back cover, a spine and pages carrying lines of text to be read, said book adapted to be positioned on said book holder whereby said book may be viewed by a person lying down in a partially or entirely sideways facing position, said person having a plane of vision, and said book holder comprising a base member and a back support member being rotatably secured to said base member to rotate about an axis of rotation, and a transparent front support member having a face being secured to said base member so as to extend from said base member in a plane parallel to said axis of rotation, said book holder having a securing means biasing said back support member and said transparent front member together to flatten said pages of said book when said book is in its open viewing position, and a first restraining means adapted to engage one of said front or said back covers of said book and operative to prevent said book from sliding in a direction towards said base member and a second restraining means, being operative as a shelf means to prevent said book from moving in a direction generally parallel with said base member, whereby said book holder either holds said book in a page viewing position, where said pages are in a generally vertical plane generally perpendicular to said plane of vision and where said lines of text of said book extend in a downward direction generally aligned with said plane of vision, or holds said book in a page turning position, where said pages are closer to the horizontal and accessible for page turning by said person.

2. A book holder according to claim 1, and said first restraining means being a rigid support means, adapted to be inserted either between the lower one of said front and back covers of said book and said pages or between said pages, to support said spine of said book from below.

3. A book holder according to claim 1, said front support member comprising at least one area allowing manual access to said pages and operative to prevent a loss of the position of said pages being read when said pages are being turned.

4. A book holder according to claim 1, said front and back support members being attached to said base member, and a connecting means to connect said front and back support members at least at one other place to hold and flatten said book between them, thereby forming a package to include said base member and said front and back support members of said book holder, and a supporting structure to support said package at an angle of tilt with respect to the vertical, and means to rotate said package with respect to said supporting structure about at least one generally horizontal or sloping axis to align said lines of text with said plane of vision of said person, or to adjust the angle of tilt of said package with respect to the vertical, or to rotate said package into a storage mode so as to reduce the height of said book holder without loss the page position.

5. A book holder according to claim 4, and further comprising a friction means acting between said package and said supporting structure, operative to stabilize the position of said package with respect to said supporting structure and to prevent said package from rotating about said axis spontaneously.

6. A book holder according to claim 4, and comprising means to lock said connecting means to prevent them from opening accidentally when said package is in said storage mode, said locking means being operated automatically by the force of gravity whenever said package is moved into said storage mode.

7. A book holder for securing a book located thereon, wherein said book has a front cover, a back cover, a spine and pages carrying lines of text to be read, said book adapted to be positioned on said book holder whereby said book may be viewed by a person lying down in a partially or entirely sideways facing position, said person having a plane of vision, and said book holder comprising a base member, a back support member, and a transparent front support member, and both said back and front support members having first edges, said edges being rotatably secured to said base member with their axes of rotation being substantially parallel with one another, and adjustment means to adjust the angular position of said front support member with respect to said base member, and said book holder having a securing means biasing said back support member and said transparent front member together to flatten said pages of said book when said book is in its open viewing position, and a first restraining means adapted to engage one of said front or said back covers of said book and operative to prevent said book from sliding in a direction perpendicular to said first edge of said back support member, and a second restraining means, being operative as a shelf means to prevent said book from moving in a direction parallel to said first edge of said back support member, whereby said book holder either holds said book in a page viewing position, where said pages are in a generally vertical plane generally perpendicular at said plane of vision and where said lines of text of said book extend in a downward direction generally aligned with said plane of vision, or holds said book in a page turning position, where said pages are closer to the horizontal and accessible for page turning by said person.

8. A book holder according to claim 7, and said first restraining means being rigid support means, adapted to be inserted either between the lower one of said front and back covers of said book and said pages or between said pages, to support said spine of said book from below.

9. A book holder according to claim 7, said front support member comprising at least one area allowing manual access to said pages and operative to prevent a loss of the position of said pages being read when said pages are being turned.

10. A book holder according to claim 7, said front and back support members being attached to said base member, and connecting means to connect said front and back support members at least at one other place to hold and flatten said book between them, thereby forming a package to include said base and said front and back support members of said book holder, and a supporting structure to support said package at an angle of tilt with respect to the vertical, and means to rotate said package with respect to said supporting structure about at least one generally horizontal or sloping axis to align said lines of text with said plane of vision of said person, or to adjust the angle of tilt of said package with respect to the vertical, or to rotate said package into a storage mode so as to reduce the height of said book holder without loss the page position.

11. A book holder according to claim 10, and further comprising a friction means acting between said package and said supporting structure, operative to stabilize the position of said package with respect to said supporting structure and to prevent said package from rotating about said axis spontaneously.

12. A book holder according to claim 10, and comprising means to lock said connecting means to prevent them from opening accidentally when said package is in said storage mode, said locking means being operated automatically by the force of gravity whenever said package is moved into said storage position.

* * * * *